US006598746B2

(12) United States Patent
Lux, Jr. et al.

(10) Patent No.: US 6,598,746 B2
(45) Date of Patent: Jul. 29, 2003

(54) DISPLAY CARTON HAVING AN INTERNALLY REINFORCED HANGER PANEL

(75) Inventors: Gerard Paul Lux, Jr., Charlotte, NC (US); Alan B. Parnell, Mooresville, NC (US); Michael J. Bittner, Charlotte, NC (US); Stephen C. Sorrells, Charlotte, NC (US); Jay Roy Gibble, Jr., Matthews, NC (US)

(73) Assignee: Washburn Graphics, Inc., Charlotte, NC (US)

( * ) Notice: Subject to any disclaimer, the term of this patent is extended or adjusted under 35 U.S.C. 154(b) by 70 days.

(21) Appl. No.: 09/952,496

(22) Filed: Sep. 13, 2001

(65) Prior Publication Data

US 2003/0047485 A1 Mar. 13, 2003

(51) Int. Cl.[7] ..... B65D 5/46
(52) U.S. Cl. ..... 206/778; 229/117.18; 493/89
(58) Field of Search ..... 229/117.12, 117.18, 229/117.09; 206/775, 778, 806, 776, 777, 769, 770; 493/75, 84, 88, 89, 110

(56) References Cited

U.S. PATENT DOCUMENTS

| | | | | |
|---|---|---|---|---|
| 1,983,323 A | | 12/1934 | Stokes | |
| 3,397,623 A | * | 8/1968 | Forrer | 493/59 |
| 3,659,704 A | | 5/1972 | Collura et al. | |
| 3,800,678 A | | 4/1974 | Wiedemann et al. | |
| 3,808,957 A | | 5/1974 | Hosoya et al. | |
| 4,106,615 A | | 8/1978 | Hiroshi | |
| 4,140,218 A | | 2/1979 | Forte | |
| 4,378,903 A | * | 4/1983 | Sherwood | 229/117.18 |
| 4,664,648 A | | 5/1987 | DuPuy | |
| 4,735,601 A | | 4/1988 | Cinotti | |
| 4,832,301 A | | 5/1989 | Hiramoto et al. | |
| 4,842,141 A | | 6/1989 | Segal | |
| 4,846,775 A | | 7/1989 | Herrin | |
| 4,858,756 A | | 8/1989 | Herrin et al. | |
| 4,946,430 A | | 8/1990 | Kohmann | |
| 5,013,004 A | | 5/1991 | Wilkins et al. | |
| 5,069,334 A | | 12/1991 | Herrin et al. | |
| 5,083,997 A | | 1/1992 | Wilkins et al. | |
| 5,117,972 A | | 6/1992 | Herrin et al. | |
| 5,259,551 A | | 11/1993 | Davis | |
| 5,328,137 A | | 7/1994 | Miller et al. | |
| 5,405,022 A | | 4/1995 | Rissley | |
| 5,458,233 A | | 10/1995 | Herrin | |
| 5,499,484 A | | 3/1996 | Herrin | |
| 5,927,496 A | | 7/1999 | Seaton et al. | |
| 5,960,947 A | | 10/1999 | Dimelis et al. | |

* cited by examiner

*Primary Examiner*—Jacob K. Ackun
(74) *Attorney, Agent, or Firm*—Summa & Allan, P.A.

(57) ABSTRACT

A packaging blank capable of forming a display carton having an internally reinforced hanger panel comprises in one embodiment a substantially rectangular front panel, a substantially rectangular back panel, a left side panel, a right side panel, a glue flap, a hanger panel, and a pliable reinforcing sheet that is secured to a portion of the hanger panel, wherein cut-outs in the hanger panel and the reinforcing sheet are correspondingly aligned to provide reinforcement to the hanger panel. Upon construction, the blank provides a display carton having an internally reinforced hanger panel. A method for internally reinforcing the hanger panel of the display carton comprises in one embodiment the steps of providing a blank and a reinforcing sheet, aligning the reinforcing sheet and blank relative to one another, and securing the reinforcing sheet to the blank, all on a single in-line apparatus.

43 Claims, 4 Drawing Sheets

DISPLAY CARTON HAVING AN INTERNALLY REINFORCED HANGER PANEL

FIELD OF THE INVENTION

The invention relates to a packaging blank. In particular, the invention relates to a packaging blank capable of forming a display carton having an internally reinforced hanger panel. The invention further relates to a display carton formed from the blank that includes a hanger panel that is internally reinforced by a pliable reinforcing sheet and that includes a hanging means. Still further, the invention relates to a method of constructing the display carton from the packaging blank on an in-line apparatus wherein the pliable reinforcing sheet is die-cut and adhered to the hanger panel of the packaging blank.

BACKGROUND OF THE INVENTION

Conventional display cartons include front panels, back panels, side panels (e.g., left and right side panels), a hanger panel, and closure panels for containing and displaying various products. As known to those skilled in the art, packaging is typically formed from packaging blanks, or blanks for short. It will be understood that as used herein the term "blank" refers to a folding carton having undergone cutting and creasing operations, but not yet having undergone folding and gluing operations. The blank may be formed of cardboard, rigid paper, flexible plastic, or similar products made of paperboard or plastic. In particular, the packaging industry favors the use of one-piece flexible blanks, which are readily incorporated into automated processes for forming display cartons. It will be further understood by those skilled in the art that the dimensions, or measurements for cartons will be expressed in the order of length (L), width (W), and depth (D), wherein L is typically the larger dimension at the open end of the carton, W is usually the smaller dimension at the open end of the carton, and D is the distance between the open ends of the carton (e.g., L×W×D). It will also be understood that the term "panel" refers to the major component part of a folding carton and defines the major outer or partition elements of the blank or carton. In addition, it will be understood that the term "product panel" may refer to either the front panel or back panel. The term "flap" refers to a secondary carton element that is typically hinge-connected along a free edge of a panel or another flap. "Tab" refers to a tertiary element of the blank or carton that is generally hinged to a portion of a free edge of a panel or flap, or struck from within the plane of a panel or flap. Finally, the term "flange" refers to a special use flap that is commonly used to describe a flap extending outwardly off the top or side edge of a panel.

As illustrated in FIG. 1, retailers typically hang display cartons containing goods on merchandise racks for viewing by potential consumers. In general, display cartons include a hanger panel extending beyond a front or back panel of the carton. The hanger panels may include cut-outs or openings in the hanger panel adapted to receive projections extending outward from a display rack. Display cartons, and especially display cartons having windows for viewing the contents of the carton, provide an efficient means to display goods because the cartons effectively utilize available shelving space. In other words, cartons can be hung on racks, for example, a peg board having horizontally projecting prongs, such that the cartons are consecutively aligned one behind the other on individual prongs, thereby maximizing shelving space. See FIG. 1. In this fashion, display cartons are readily removable by potential consumers for viewing or purchase.

As a result of the continuing removal and replacement of display cartons by potential consumers, conventional hanger panels forming part of the display carton are often destroyed. Common solutions to the destruction of hanger panels include increasing the weight of the paperboard used for the whole package or external plastic reinforcement hooks that are adhered to the hanger panel. In particular, conventional cut-outs (e.g., slots, holes, etc.) in the hanger panel are often ripped after repeated removal and replacement of the cartons, thereby destroying the means with which to hang the cartons.

Nevertheless, the use of heavyweight paperboard or external plastic hooks present additional considerations and problems. For example, the use of a heavier paperboard for the whole package increases the costs associated with manufacturing the display cartons. Further, the use of plastic reinforcement hooks secured to the exterior surface of the hanger panel increases the overall hanging depth of the display carton, thereby reducing the number of cartons that can be displayed on a merchandise rack. Additionally, the external plastic hook detracts from the aesthetic appeal of the display carton and increases the labor associated with manufacturing the display carton (e.g., additional labor step in attaching the hooks to the carton).

Thus, a more attractive option is to enhance the reinforcement provided in the hanger panel without increasing the overall size of the display carton, thereby minimizing product waste resulting package detritions, reducing costs associated with the manufacture of the display carton, and providing an aesthetically appealing display carton.

Conventional methods for manufacturing display cartons typically include the steps of die-cutting a cut-out in an external reinforcement means (e.g., external hook) on one in-line apparatus, transferring the reinforcement means to a second in-line apparatus, and then securing the external reinforcement means to a hanger panel of a packaging blank on a separate in-line apparatus. This method is labor intensive and requires the use of two separate apparatuses.

Accordingly, a more attractive option for manufacturing display cartons having reinforced hanger panels is to perform the die-cutting step on a reinforcement means and the securing step on a single in-line apparatus.

OBJECT AND SUMMARY OF THE INVENTION

It is therefore an object of the present invention to provide a blank capable of being constructed into a display carton having a reinforced hanger panel, and preferably, an internally reinforced hanger panel.

Another object of the invention is to provide a packaging blank that can be readily incorporated into existing in-line processes without the need for off-line die-cutting and sizing stations for reinforcing a hanger panel on a display carton.

Yet another object of the invention is the provision of a display carton formed from a blank that provides reinforcement to a hanger panel, and preferably an internally reinforced hanger panel, in order to reduce the incidence of product waste resulting from carton deterioration.

A further object of the invention is to provide a container having a reinforced hanger panel that includes a means for hanging the carton.

Another object of the invention is to maximize the durability of a display carton.

Still another object of the invention is to maximize the aesthetic appeal of a display carton.

A further object of the invention is to increase the manufacturing efficiencies associated with constructing display cartons having reinforced hanger panels.

The invention meets these objectives with a packaging blank capable of forming a display carton having a hanger panel that is reinforced, and preferably internally reinforced, by a pliable reinforcing sheet. In particular, the invention is a packaging blank having a reinforced hanger panel that define a means for hanging the carton. The invention further meets these objectives with a method for reinforcing the hanger panel that accomplishes the steps of forming a window and a reinforced hanger panel on a single in-line apparatus.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
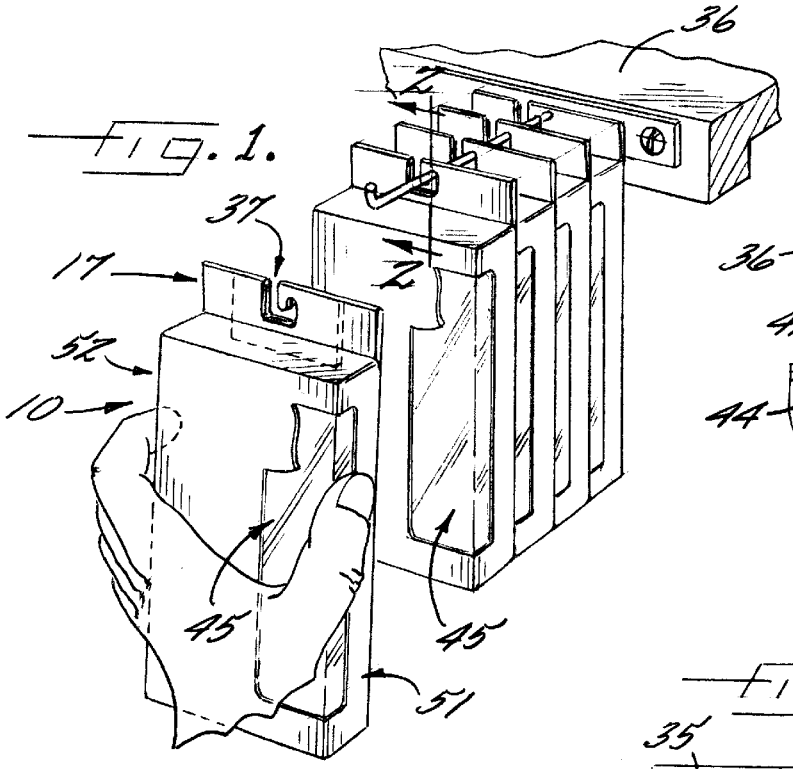
FIG. 1 is a perspective view of a preferred embodiment of the display carton formed from the packaging blank as used in connection with a merchandise display rack.

An overall view of a display carton 10 formed from packaging blank 11 which incorporates features of the present invention is set forth in FIG. 1. As used herein, the term "panel" as defined above is used in conjunction with the packaging blank and the container formed from the blank and refers to components of the blank and walls of the container.

Figure 3:
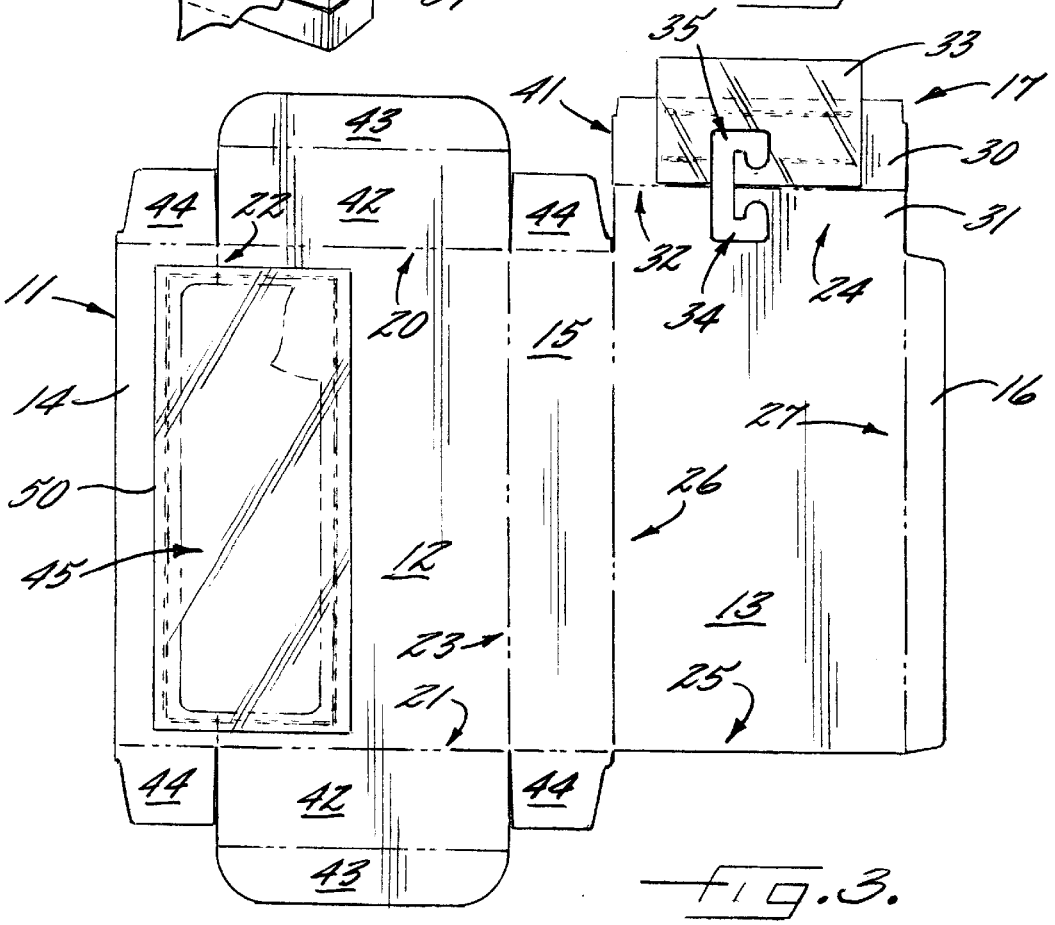
FIG. 3 is top plan view of the preferred embodiment of the packaging blank illustrating a front panel, a back panel, a left side panel, a right side panel, a glue flap, a hanger panel having a front hanger tab panel, a rear hanger tab panel, and associated cut-out, a reinforcing sheet and associated cut-out, closure panels, tuck flaps, dust flaps, and a windowed opening covered with film.

As depicted in FIG. 3, the packaging blank 11 includes a front panel 12, a back panel 13, a left side panel 14, a right side panel 15, a glue flap 16, and a hanger panel 17. As noted above, the front 12 and back panel 13 may also be referred to, individually, as a product panel. In a preferred embodiment of the invention, the blank 11 is a one-piece flexible blank. In this preferred embodiment, at least one side of the blank is finished. As used herein, it will be understood that the term "finished" means coated with a material to produce an attractive glossy finish. The term "finished" will also be understood to mean the inclusion of printed material or other identifying indicia (e.g., a company's logo, instructions, and directions for opening the display carton formed from the blank). It will be understood by those of skill in the art that the terms "front panel" and "back panel" are also referred to as "top panel" and "bottom panel" in the packaging industry depending upon the orientation of the blank or carton with respect to a horizontal plane. Further, it will be understood that the relative terms "front panel" and "back panel" may often be referred to as "back panel" and "front panel", respectively, depending upon the orientation of the blank or carton with respect to the position of an observer relative to the orientation of the blank or carton. Moreover, it will be understood that a "side panel" may be referred to as a "left side panel" or "right side panel", interchangeably, depending upon the orientation of the blank or carton with respect to the position of an observer relative to the orientation of the blank or carton.

With reference to the orientation of the blank in FIG. 3, it will be understood that with respect to the present invention, the term length (L) refers to a distance measured from the uppermost left portion of either the front or back panel 12, 13 to the uppermost right portion of either the front or back panel. It will be further understood that the term width (W) refers to a distance measure from the uppermost left portion of either the left side panel 14 or right side panel 15 to the uppermost right portion of either the left or right side back panel. Moreover, referring still to FIG. 3, the term depth (D) refers to a distance measured from the uppermost portion of either the front or back panel 12, 13 to the lowermost portion of either the front or back panel.

It will be further appreciated by those of ordinary skill in the art that, as used herein, the concept of a panel being "between" two other panels or walls does not necessarily imply that the three panels or walls are contiguous (i.e., in intimate contact). Rather, as used herein, the concept of one panel being between two other panels or walls is meant to describe the relative positions of the panels within the blank or container structure, respectively. Similarly, as used herein, the concept of a first panel being connected to a second panel by a third panel, "opposite" the second panel, merely describes the relative positions of the first and second panels within the blank structure.

The front panel 12 of the preferred blank 11 as shown in FIG. 3 is substantially rectangular in shape and includes a top boundary 20, bottom boundary 21, left boundary 22, and right boundary 23. The back panel 13 of the preferred blank 11 is also substantially rectangular in shape and likewise includes a top boundary 24, bottom boundary 25, left boundary 26, and right boundary 27. The left side panel 14 is joined to the front panel 12 at the left boundary 22 of the front panel. The right side panel 15 is joined to the front panel 12 at the right boundary 23 of the front panel and is further joined to the back panel 13 at the left boundary 26 of the back panel, thereby connecting the front panel to the back panel. The glue flap 16 is joined to the back panel 13 at the right boundary 27 of the back panel.

Figure 4A:
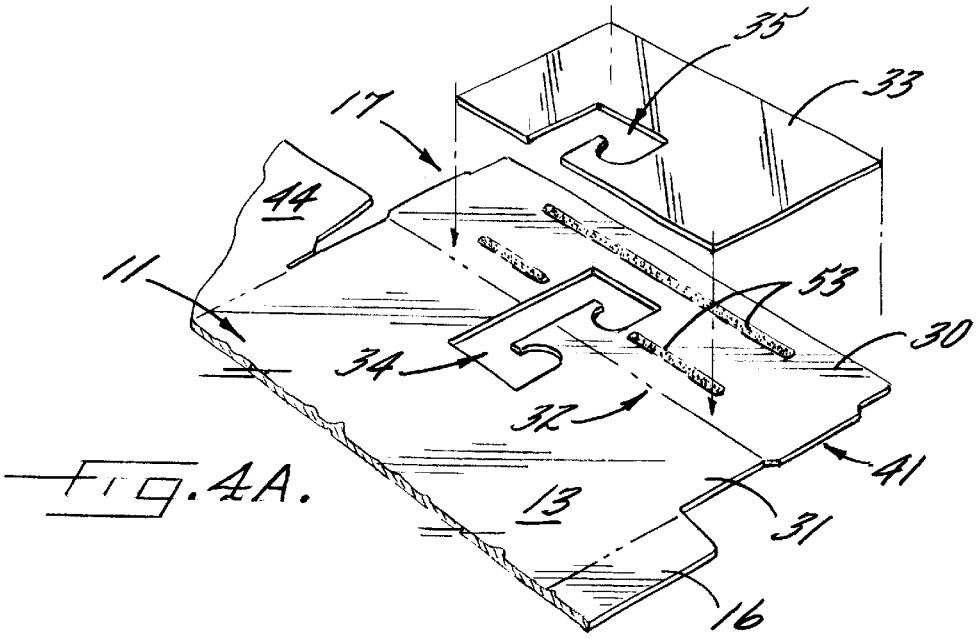
FIG. 4A is an enlarged partial sectional view of the preferred embodiment of the hanger panel having a C-shaped cut-out depicting the placement of the reinforcing sheet on the front hanger tab panel of the hanger panel with an adhesive.
Figure 4B:
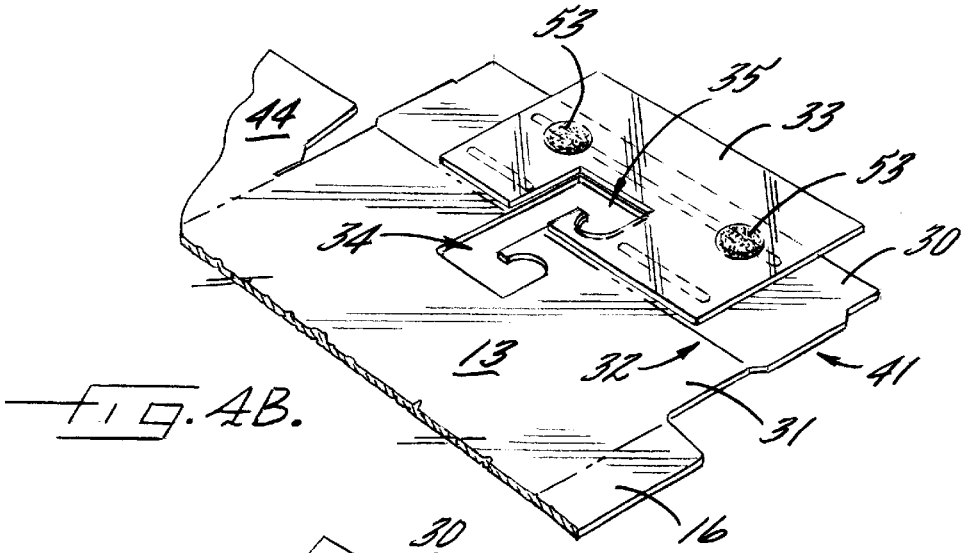
FIG. 4B is an enlarged partial sectional view of the preferred embodiment of the hanger panel illustrating the reinforcing sheet secured to the front hanger tab panel wherein the hanger panel cut-out and the reinforcing sheet cut-out are aligned.
Figure 4C:
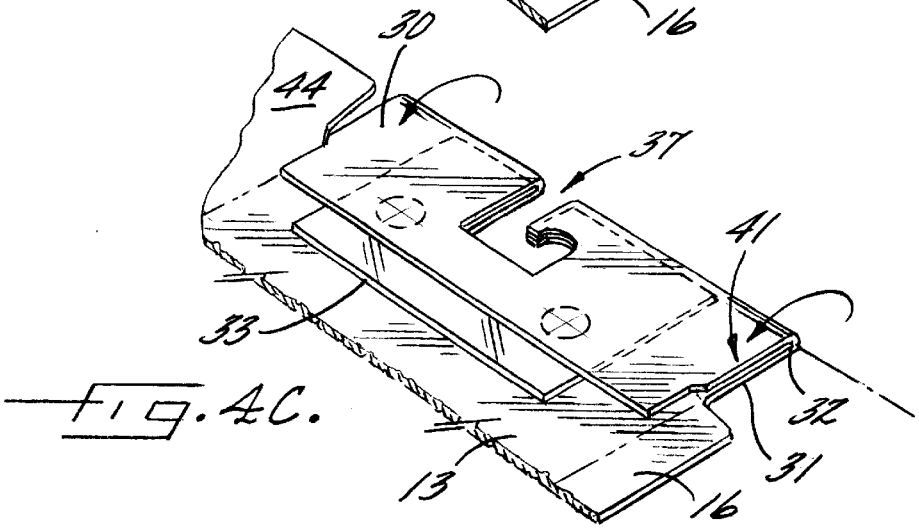
FIG. 4C is an enlarged partial sectional view of the preferred embodiment of the hanger panel depicting the folding of the front hanger tab panel—and the reinforcing sheet secured thereto—over the rear hanger tab panel so that the cut-outs are correspondingly aligned to form a hook-shaped cut-out in the hanger panel.

The hanger panel 17 extends beyond the top boundary 24 of the back panel 13 and is comprised of a front hanger tab panel 30 and a rear hanger tab panel 31 depicted in FIG. 4A. Preferably, the hanger panel 17 is substantially rectangular in shape, but is not limited to a rectangular shape and may, for example, be oval, polygonal, or elliptical. Referring to FIGS. 4A and 4C, the front hanger tab panel 30 is foldable over the rear hanger tab panel 31 such that the front and rear hanger tab panels define a hanger panel fold line 32 in the packaging blank 11. The rear hanger tab panel 31 is joined to the back panel 13 at the top boundary 20 of the back panel.

Figure 5A:
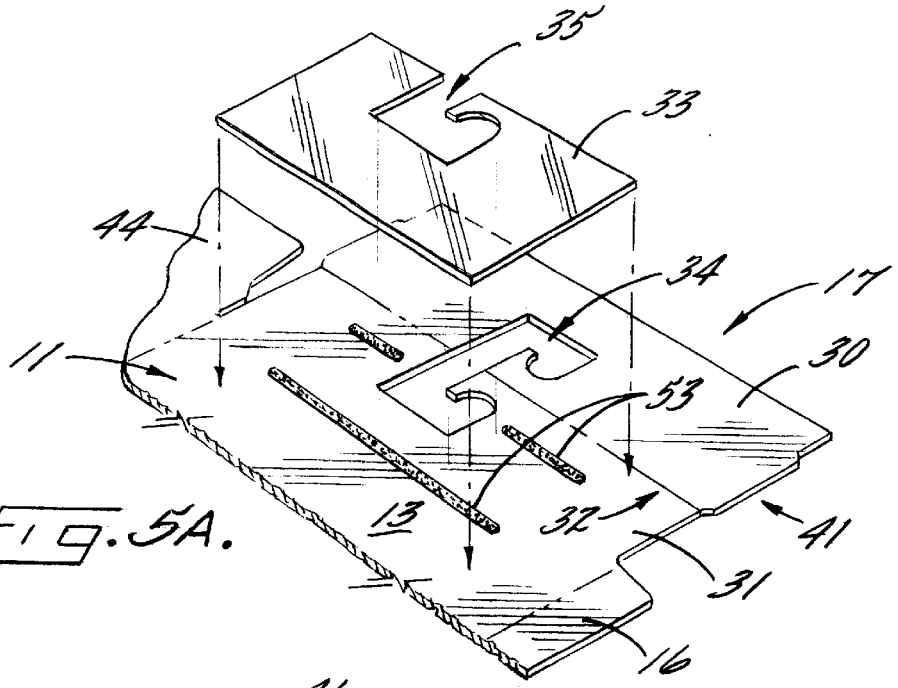
FIG. 5A is an enlarged partial sectional view of another preferred embodiment of the hanger panel having a C-shaped cut-out depicting the placement of the reinforcing sheet on the rear hanger tab panel of the hanger panel with an adhesive.
Figure 5B:
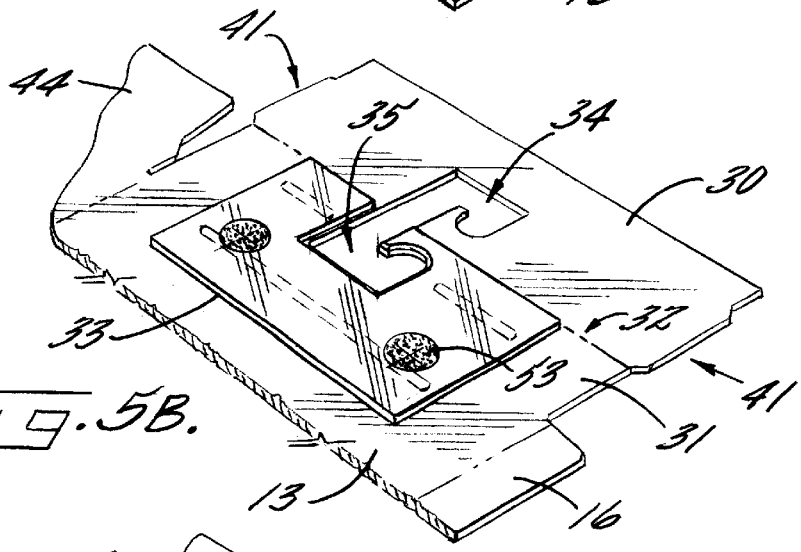
FIG. 5B is an enlarged partial sectional view of the other preferred embodiment of the hanger panel illustrating the reinforcing sheet secured to the rear hanger tab panel wherein the hanger panel cut-out and the reinforcing sheet cut-out are aligned.
Figure 5C:
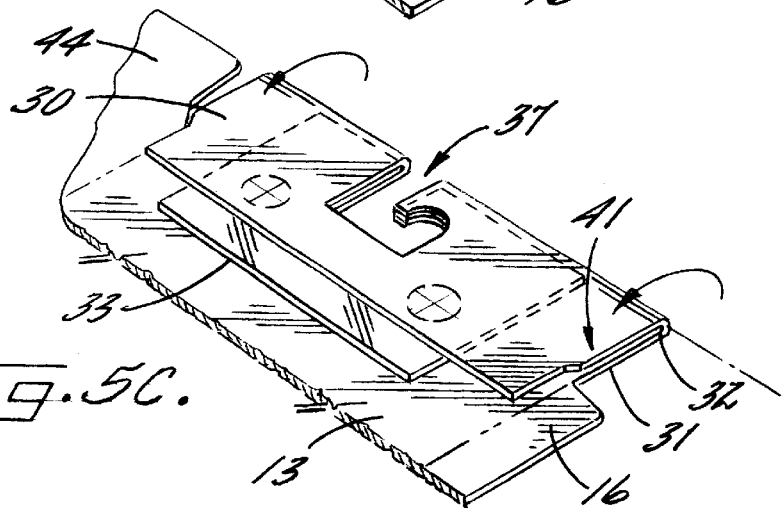
FIG. 5C is an enlarged partial sectional view of the other preferred embodiment of the hanger panel depicting the folding of the front hanger tab panel over the rear hanger tab panel so that the cut-outs are correspondingly aligned to form a hook-shaped cut-out in the hanger panel

A pliable reinforcing sheet 33 is secured to a portion of the hanger panel 17 and positioned adjacent the hanger panel fold line 32 as illustrated in FIG. 3. As illustrated in FIGS. 4A, 4B, and 4C, the reinforcing sheet 33 is preferably secured to the front hanger tab panel 30 with an adhesive 53 (e.g., fugitive glue). Nevertheless, the reinforcing sheet 17 may also be secured to the rear hanger tab panel 31 as depicted in FIGS. 5A, 5B, and 5C. The reinforcing sheet 33 is provided to reinforce the hanger panel 17 and thus reduce the incidence of carton destruction. It will be understood that the pliable reinforcing sheet 33 may be formed from any number of flexible materials to include, but not limited to, polyester film or resin-impregnated paperboard. In a preferred embodiment, the reinforcing sheet 33 is substantially rectangular, yet may be, for example, oval, polygonal, or elliptical.

As depicted in FIGS. 3 and 4C, the front hangar tab panel 30 has a depth (D) greater than the rear hanger tab panel 31 such that the front hanger tab panel overlaps at least a portion of the back panel 13 when the front hanger tab panel and the reinforcing sheet 33 secured thereto are folded over and against the rear hanger tab panel during construction of the packaging blank 11 into a display carton. The portion of the front hanger tab panel 30 that overlaps the back panel 13 further reinforces the hanger panel 17 by providing a greater surface area to support the reinforcing sheet 33 as compared to the surface area of the rear hanger tab panel 31.

Advantageously, the construction of the packaging blank 11 and the resulting carton 10 produced there from, permits the hanger panel 17, the reinforcing sheet 33, or both the hanger panel and the reinforcing sheet to define a hanging means. The hanging means provides a useful means to hang the packaging blank when it is constructed into a display carton.

In one embodiment the hanger panel 17, the pliable reinforcing sheet 33, and cut-outs associated with the hanger panel and reinforcing sheet form the preferred hanging means. Stated differently, the preferred hanging means is comprised of a C-shaped cut-out 34 in the hanger panel 17 and a substantially hook-shaped cut-out 35 in the reinforcing sheet 33. See FIGS. 4A, 4B, and 4C. It will be understood that the term "hook-shaped" as used in this description of the preferred embodiment of the reinforcing sheet cut-out 35 encompasses any number of shaped cut-outs that permit the hanging of the packaging blank, upon construction into the display carton 10, from a conventional merchandise rack 36. For example, the reinforcing sheet cut-out 35 may be substantially L-shaped or J-shaped. In alternative embodiments, the reinforcing sheet cut-out may be T-shaped or may be circular in shape. Furthermore, it will be understood that the cut-outs may include, but are not limited to, a slit, a slot, or a hole formed in the hanger panel or reinforcing sheet.

In this fashion, the hanging means of the packaging blank 11 is composite in nature, being formed from paperboard of the preferred blank 11 and, for example, polyester film of the preferred reinforcing sheet 33. Advantageously, the composite structure enhances the structural integrity of the hanger panel 17.

Figure 2:
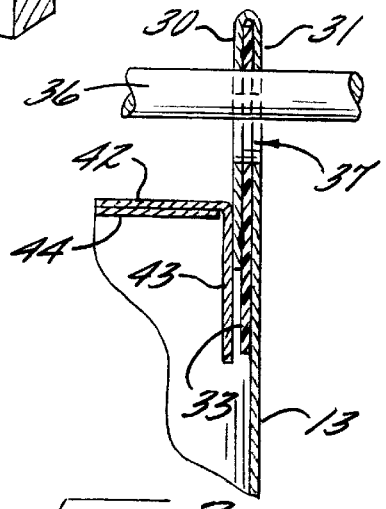
FIG. 2 is a side sectional view taken generally along lines 2—2 of FIG. 1 depicting a hanger panel and associated cut-out, a front hanger tab panel, a rear hanger tab panel, a reinforcing sheet and associated cut-out, a back panel, a closure panel, a tuck flap, and a dust flap.

As depicted in FIGS. 2 and 4C, the hanger panel cut-out 34 and the reinforcing sheet cut-out 35 are aligned to correspondingly form a substantially hook-shaped cut-out 37 in the hanger panel 17 when the front hanger tab panel 30—and preferably the reinforcing sheet 33 attached thereto—are folded over and against the rear hanger tab panel 31 along the hanger panel fold line 32 during construction of the display carton 10. It will be understood, however, that the reinforcing sheet 17 may also be secured to the rear hanger tab panel 31. See FIGS. 5A, 5B, and 5C. In other words, the C-shaped cut-out 34 in the hanger panel forms a hook-shaped cut-out when the front hanger tab panel 30 is folded over the rear hanger tab panel 31, thereby sandwiching the reinforcing sheet 33 between the front and rear hanger tab panels. See FIG. 2. Upon folding, the reinforcing sheet cut-out 35 and the hanger panel cut-out 34 are aligned to form the preferred hanging means. In this preferred embodiment, the front hanger tab panel 30 conceals the reinforcing sheet 33 such that only the reinforcing sheet cut-out 35 is exposed, as depicted in FIGS. 1 and 4C. Accordingly, the present invention provides a pliable reinforcing sheet secured to the hanger panel 17 such that the reinforcing sheet 33 is integrated into the interior of the hanger panel during construction of the display carton 10 and thereby provides an internally reinforced hanger panel. See FIG. 2.

Figure 6A:
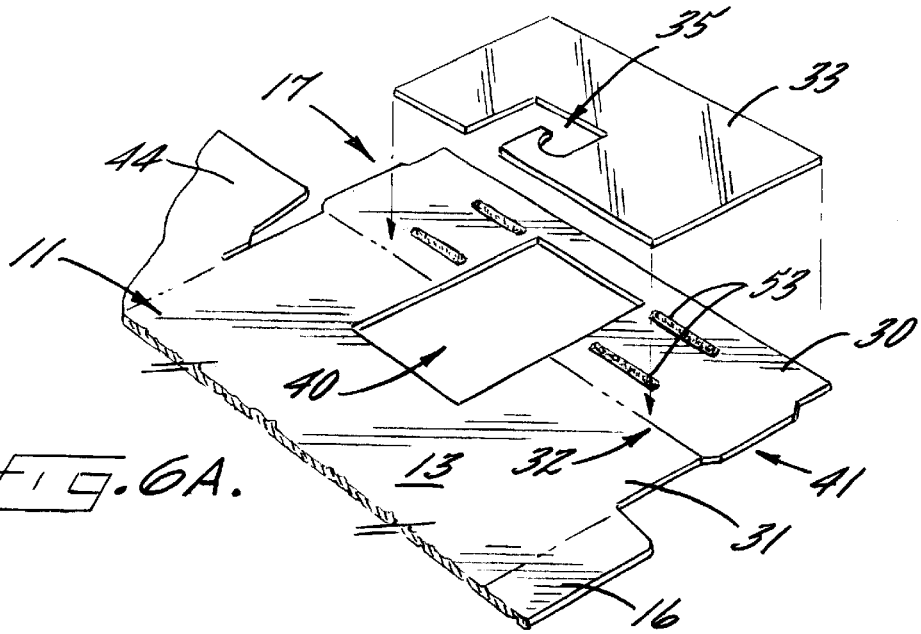
FIG. 6A is an enlarged partial sectional view of the alternative embodiment of the hanger panel having a rectangular shaped cut-out depicting the placement of the reinforcing sheet on the front hanger tab panel of the hanger panel with an adhesive.
Figure 6B:
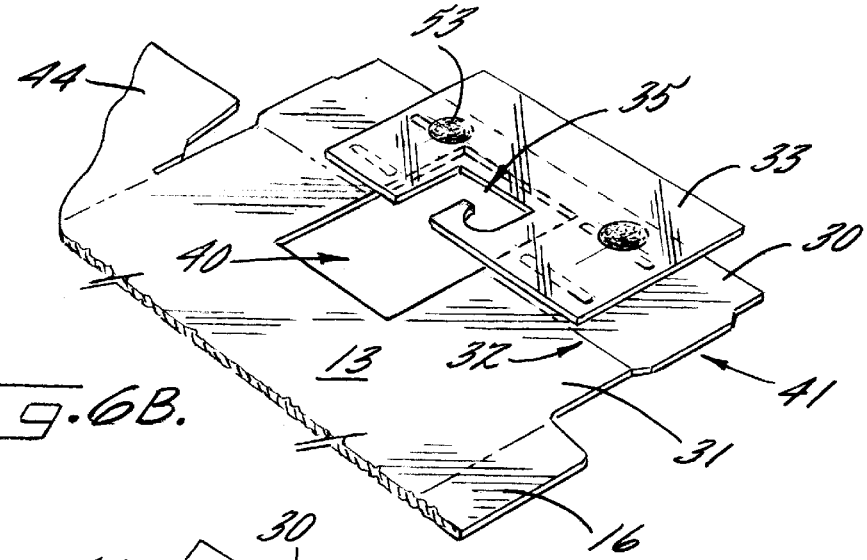
FIG. 6B is an enlarged partial sectional view of the alternative embodiment of the hanger panel illustrating the reinforcing sheet secured to the front hanger tab panel.
Figure 6C:
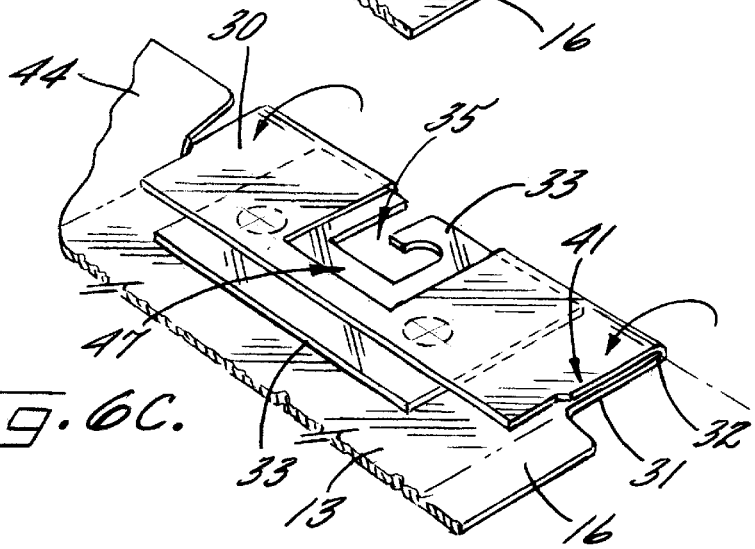
FIG. 6C is an enlarged partial sectional view of the alternative embodiment of the hanger panel depicting the folding of the front hanger tab panel—and the reinforcing sheet secured thereto—over the rear hanger tab panel so that a portion of the reinforcing sheet and associated cut-out are exposed.

In an alternative embodiment illustrated in FIGS. 6A, 6B, and 6C, the reinforcing sheet 33 and associated cut-out 35 form the hanging means. In other words, the hanging means may be comprised of a substantially rectangular shaped cut-out 40 in the hanger panel 17 and the hook-shaped cut-out 35 in the pliable reinforcing sheet 33. Thus, as shown in FIG. 6C, a portion of the reinforcing sheet 33 other than the cut-out 35 is exposed when the front hanger tab panel 30 is folded over and against the rear hanger tab panel 31 during construction of the display carton. It will be understood that the reinforcing sheet 33 can be secured to either the front or rear hanger tab panels 30, 31.

In this embodiment, the rectangular cut-out 40 in the hanger panel 17 retains its rectangular shape when the front hanger tab panel 30 is folded over the rear hanger tab panel 31. In other words, the rectangular cut-out 40 defined by four sides of the hanger panel 17 forms a rectangular cut-out 47 that is approximately half its original size when the hanger panel is folded. Accordingly, the folded hanger panel cut-out 47 is defined by three sides of the hanger panel 17. The portion of the reinforcing sheet 33 exposed in this alternative embodiment is greater than the portion exposed in the preferred embodiment described above. Thus, an area of the reinforcing sheet 33 immediately surrounding the reinforcing sheet cut-out 35 is not concealed by the hanger panel 17. As a result, the reinforcing sheet 33, and thus the hanging means of the alternative embodiment, is more flexible than the reinforcing sheet of the preferred embodiment that is concealed by the hanger panel 17. The more flexible reinforcing sheet 33 forming the hanging means of the alternative embodiment thereby facilitates the ease with which the display carton 10, and specifically the hanger panel 17, is secured to and removed from the merchandise display rack 36. Briefly, the flexible nature of the exposed reinforcing sheet 33 permits an individual stocking shelves to approximate the alignment of the reinforcing sheet cut-out 35 and a prong on the display rack when securing the display carton 10 on the rack. See FIGS. 1 and 2.

The front hanger tab panel 30 includes a pair of flanges 41 disposed on opposite sides of the front hanger tab panel as depicted in FIG. 3. Referring to FIG. 4A, the depth of the flanges 41 is substantially equal to the depth of the rear hanger tab panel 31. As such, the flanges 41 as illustrated in FIG. 4C conceal the rear hanger tab panel 31 and the reinforcing sheet 33 from view to thereby provide an aesthetically appealing display carton 10. See FIG. 1. Stated differently, the flanges 41 extending outwardly from the front hanger tab panel 30 hide the reinforcing sheet 33 from view, thereby enhancing the aesthetic appeal of the display carton 10.

In the preferred and alternative embodiments of the blank 11, a pair of closure panels 42 is attached to the top boundary 20 and bottom boundary 21 of the front panel 12. As configured, the blank 11 is capable of forming a closed end carton 10 as depicted in FIG. 1. The preferred and alternative embodiments may also include a tuck flap 43 depicted in FIG. 3 that is formed at one end of each pair of opposing closure panels 42. Both embodiments of the present invention provide dust flaps 44 formed at opposing ends of the left side panel 14 and right side panel 15.

With reference to FIG. 3, the preferred and alternative embodiments of the packaging blank 11 may further include a windowed opening 45 in the front panel 12, the left side panel 14, or the right side panel 15. It will be understood by those skilled in the art that the term "windowed opening" refers to a cut-out in a blank that permits viewing of the interior of a carton formed from the blank. In this embodiment, at least a portion of the back panel 13, the left side panel 14, or the right side panel 15 is viewable through the windowed opening 45 when the packaging blank 11 is constructed into the carton 10. The embodiments having a windowed opening 45 may further comprise a sheet of transparent film 50 secured to at least one side of the packaging blank 11 with an adhesive. Preferably, the transparent film 50 is secured adjacent edges of the blank defining the windowed opening 45 such that the transparent film covers the opening and protects the contents of the carton formed from the blank, yet allows a potential consumer to view the contents therein. The transparent film 50 may include, but is not limited to, polyester-based or polyethylene-based film.

Another aspect of the present invention includes a display carton 10 formed from the packaging blank 11. Accordingly, the elements of the preferred and alternative embodiments of the display carton discussed below reflect like numerals, unless otherwise indicated, with respect to the preferred and alternative embodiments of the packaging blank. The display carton provides a front panel 12, back panel 13, a first side panel 51, a second side panel 52, a glue flap 16, a hanger panel 17, a reinforcing sheet 33, and a pair of closure panels 42. It will be understood that when referring to the display carton, the left and right side panels 14, 15 of the blank will be referred to as the first and second side panels 51, 52 of the display carton, respectively.

In a preferred embodiment of the invention, the display carton 10 consists of a one-piece flexible blank 11 and a pliable reinforcing sheet 33. In this preferred embodiment, the display carton has an interior surface and an exterior surface, wherein the exterior surface is finished.

The front panel 12 of the preferred carton 10 as shown in FIG. 1 is substantially rectangular in shape and includes a top boundary 20 and a bottom boundary 21. The back panel 13 of the preferred carton is also substantially rectangular in shape and likewise includes a top boundary 24 and a bottom boundary 25. The first side panel 51 and second side panel 52 connect the front panel 12 to the back panel 13. The glue flap 16 is facially adhered to the first side panel 51, and thus joins a portion of the back panel 13 to the first side panel 12. It will be understood that the glue flap 16 may be adhered with a variety of adhesives to include glue (e.g., fugitive glue).

The hanger panel 17 is joined to and extends beyond the top boundary 24 of the back panel 13. The hanger panel 17 is comprised of a front hanger tab panel 30 and a rear hanger tab panel 31 that are folded over and against each other such that the front hanger tab panel overlaps a portion of the back panel. In a preferred embodiment, the hanger panel 17 is substantially rectangular in shape. Nevertheless, the shape of the hanger panel is not limited to a rectangle and may, for example, be oval, polygonal, or elliptical.

The front hanger tab panel 30 includes a pair of flanges 41 disposed on opposite sides of the front hanger tab panel. As described in regards to the packaging blank above, the depth of the flanges 41 is substantially equal to the depth of the rear hanger tab panel 17, such that the flanges conceal the rear hanger tab panel and the reinforcing sheet 33 from view to thereby provide an aesthetically appealing display carton 10. See FIG. 1.

As constructed, the preferred display carton 10 forms a substantially rectangular container. Accordingly, the front and back panels 12, 13 of the display carton 10 form substantially parallel planes. Furthermore, the first side panel 51 and second side panel 52 form substantially parallel planes that are perpendicular to the parallel planes of the front and back panel 12, 13.

The display carton 10 provides a pliable reinforcing sheet 33 that is secured between the front hanger tab panel 30 and the rear hanger tab panel 31, and consequently, reinforces the hanger panel 17 internally. As noted above, it will be understood that the pliable reinforcing sheet 33 may be formed from any number of flexible materials to include, but not limited to, polyester film or resin-impregnated paperboard. The reinforcing sheet 33 is preferably rectangular, but may be oval, polygonal, or elliptical. Moreover, the display carton 10 is preferably formed from a one-piece flexile blank and the pliable reinforcing sheet 33.

The display carton 10 further provides a means for hanging the display carton on conventional merchandise display racks 36, wherein the hanger panel 17 defines the hanging means. In one embodiment, the hanging means is comprised of the hook-shaped cut-out 35 in the reinforcing sheet 33 and the cut-out 34 in either the front hanger tab panel 30 or the rear hanger tab panel 31, such that the cut-outs are aligned to correspondingly form a hook-shaped cut-out in said hanger panel. As depicted in the preferred embodiment of FIG. 1, the hanger panel cut-out 34 and the reinforcing sheet cut-out 35 are aligned to correspondingly form a substantially hook-shaped cut-out 37 in the hanger panel. Accordingly, the hanger panel 17 conceals the reinforcing sheet 33. As described the preferred hanging means of the display carton is composite in nature, thereby enhancing the structural integrity of the hanger panel.

In an alternative embodiment, the reinforcing sheet 33 and associated cut-out 35 define the hanging means. In particular, the hanging means of the display carton 10 is comprised of a substantially rectangular shaped cut-out 47 defined by the front hanger tab panel 30 and the rear hanger tab panel 31 and a hook-shaped cut-out 35 in the pliable reinforcing sheet. As described above in regards to the packaging blank 11, a portion of the reinforcing sheet 33 in the hanger panel 17 is exposed and thus the hanging means of the alternative embodiment is more flexible than the hanging means of the preferred embodiment. Likewise, the hanging means of the alternative embodiment of the display carton 10 facilitates the ease with which the display carton, and specifically the hanger panel 17, is secured to and removed from a merchandise display rack 36.

The preferred and alternative embodiments of the display carton 10 may also include a pair of closure panels 42 that are connected to the top boundary 20 and bottom boundary 21 of the front panel 12. Tuck flaps 43 are provided at one end of each pair of the closure panels 42. Furthermore, the first side panel 51 and the second side panel 52 of the display carton 10 include a pair of dust flaps 44 formed at opposing ends of the first and second side panels.

The preferred and alternative embodiments of the display carton may include a windowed opening 45 defined by the front panel 12, the first side panel 51, or the second side panel 52. Thus, at least a portion of the back panel 13, the first side panel 51, or the second side panel 52 is viewable through the opening 45 in the display carton 10. The embodiments of the display carton 10 having the windowed opening 45 may further comprise a sheet of transparent film 50 secured to either the interior or exterior surface of the display carton such that the transparent film covers the opening and protects the contents of the carton, while permitting a potential consumer to view the contents therein. The transparent film 50 may include, but is not limited to, polyester- or polyethylene-based film.

Another aspect of the invention includes the use of the preferred packaging blank described above in conjunction with a method for reinforcing the hanger panel of the display carton with a pliable reinforcing sheet. It will be understood that the present method can be performed on a variety of commercially available in-line apparatuses for forming display cartons. This method is preferably accomplished on a single in-line apparatus capable of forming a windowed opening. The present method provides for the die-cutting of a hook-shaped cut-out in the reinforcing sheet and the subsequent securing of the reinforcing sheet to the hanger panel of a packaging blank all on a single in-line apparatus, thereby eliminating the necessity of transferring the packaging blank to a separate apparatus for attaching reinforcements as described above (e.g., external hook).

In a preferred method, the packaging blank of the preferred embodiment having a plurality of cut-outs and fold lines is provided on an in-line apparatus.

Upon providing the packaging blank on the in-line apparatus, a pliable reinforcing sheet for reinforcing the hanger panel is provided on the in-line apparatus. In a preferred method, the reinforcing sheet is in the form of a continuous roll provided on a cylinder of the in-line apparatus. It will be understood that the reinforcing sheet provided may also be in the form of individual sections provided in a feeder on the in-line apparatus.

Next, the blank and reinforcing sheet are aligned relative to one another such that cut-outs formed in the reinforcing sheet and the hanger panel are aligned to correspondingly form a hook-shaped cut-out. During the alignment step, a hook-shaped cut-out is die-cut into portions of the continuous pliable reinforcing sheet at a die-cutting unit provided on the in-line apparatus. Subsequently, the continuous reinforcing sheet provided by the cylinder is cut into sections of reinforcing sheet for placement on the hanger panel of the packaging blank. This is accomplished at a cutting section provided on the in-line apparatus.

After the individual sections of reinforcing sheet are sized for placement on the packaging blank, a section of reinforcing sheet and the packaging blank are advanced to positions adjacent one another in preparation for the securing step.

The cut section of reinforcing sheet is then secured to the packaging blank, and specifically the hanger panel, to thereby provide a packaging blank that is capable of being constructed into a display carton having a reinforced hanger panel. During the securing step, adhesive is applied to a portion of the hanger panel to which the reinforcing sheet is secured. Thus, the adhesive may be applied to either the front or rear hanger tab panel. The adhesive may be applied by a conventional glue applicator provided on the in-line apparatus. Thereafter, the reinforcing sheet is positioned on either the front or rear hanger tab panel bearing the adhesive to thereby secure the section of reinforcing sheet to the hanger panel. Upon constructing the hanger panel, the blank can be advanced to a folding station wherein the blank is constructed into a carton. In particular, the front hanger tab panel can be folded over the rear hanger tab panel to form the hanging means of the carton. Regardless of whether the reinforcing sheet is secured to the front or rear hanger tab panel, the reinforcing sheet is captured between the front and rear hanger tab panel when the front hanger tab panel is folded over the rear hanger tab panel.

In an optional windowing step of the present method, cut-outs provided in the packaging blank are formed into windows by covering the cut-outs with a transparent film. To accomplish the windowing step, the packaging blank and reinforcing sheet attached thereto is advanced along the in-line apparatus to a windowing station for the application of the transparent film to a selected cut-out in the packaging blank. During the windowing step, adhesive is applied by a second glue applicator provided on the in-line apparatus to a portion of the packaging blank to which the transparent film is secured.

Upon applying adhesive to portions of the packaging blank adjacent the selected cut-out, edges of the transparent film are secured to the cut-out that bears the adhesive to thereby form a windowed opening. The optional windowing step thus provides a potential consumer with an internal view of the display carton upon construction.

Beneficially, the present method incorporates the steps of die-cutting and securing a reinforcement means (e.g., pliable reinforcing sheet) on a single in-line apparatus, thereby increasing manufacturing efficiencies as compared to conventional methods requiring two separate in-line apparatuses to perform the same operation. Furthermore, the method can be performed on commercially available in-line apparatuses that are also capable of forming windowed openings on a blank.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. A packaging blank that is capable of forming a display carton having a reinforced hanger panel, said blank comprising:

a substantially rectangular product panel having a top boundary, bottom boundary, left boundary, and right boundary;

a hanger panel comprising a front hanger tab panel and a rear hanger tab panel that define a hanger panel fold line, said hanger panel extending beyond said top boundary of said product panel, said rear hanger tab panel joined to said product panel at said top boundary of said product panel, and said front hanger tab panel being foldable over said rear hanger tab panel along said hanger panel fold line; and a pliable reinforcing sheet for reinforcing said hanger panel, said reinforcing sheet secured to at least a portion of said hanger panel adjacent said hanger panel fold line;

wherein said hanger panel, said reinforcing sheet, or both said hanger panel and said reinforcing sheet define a hanging means, said hanging means providing a useful means to hang said packaging blank when constructed into a display carton.

2. A packaging blank according to claim 1, wherein at least one side of said packaging blank is finished and includes printed media.

3. A packaging blank according to claim 1, wherein said packaging blank consists essentially of a one-piece flexible blank and said pliable reinforcing sheet.

4. A packaging blank according to claim 1, wherein said hanger panel is substantially rectangular.

5. A packaging blank according to claim 1, wherein said pliable reinforcing sheet is substantially rectangular.

6. A packaging blank according to claim 1, wherein said front hangar tab panel has a depth greater than said rear hanger tab panel such that said front hanger tab panel overlaps at least a portion of said product panel when said front hanger tab panel is folded over and against said rear hanger tab panel during construction of said packaging blank into a display carton.

7. A packaging blank according to claim 1, wherein said hanging means comprises:

a C-shaped cut-out defined by said hanger panel; and a hook-shaped cut-out defined by said reinforcing sheet;

wherein said hanger panel cut-out and said reinforcing sheet cut-out are aligned to correspondingly form a substantially hook-shaped cut-out in said hanger panel when said front hanger tab panel is folded over and against said rear hanger tab panel along said hanger panel fold line during construction of a display carton.

8. A packaging blank according to claim 1, wherein said hanging means comprises:

a substantially rectangular shaped cut-out in said hanger panel; and a hook-shaped cut-out defined by said pliable reinforcing sheet;

wherein at least a portion of said reinforcing sheet is exposed when said front hanger tab panel is folded over and against said rear hanger tab panel along said hanger panel fold line during construction of a display carton to thereby facilitate the ease with which the display carton is secured to and removed from a merchandise display rack.

9. A packaging blank that is capable of forming a display carton having an internally reinforced hanger panel, said blank comprising:

a substantially rectangular front panel having a top boundary, bottom boundary, left boundary, and right boundary;

a substantially rectangular back panel having a top boundary, bottom boundary, left boundary, and right boundary;

a left side panel joined to said front panel at said left boundary of said front panel;

a right side panel joined to said front panel at said right boundary of said front panel, and joined to said back panel at said left boundary of said back panel;

a glue flap joined to said right boundary of said back panel;

a hanger panel comprising a front hanger tab panel and a rear hanger tab panel that define a hanger panel fold line, said hanger panel extending beyond said top boundary of said back panel, said rear hanger tab panel joined to said back panel at said top boundary of said back panel, and said front hanger tab panel being foldable over said rear hanger tab panel along said hanger panel fold line; and a pliable reinforcing sheet for reinforcing said hanger panel, said reinforcing sheet secured to at least a portion of said hanger panel adjacent said hanger panel fold line;

wherein said hanger panel, said reinforcing sheet, or both said hanger panel and said reinforcing sheet define a hanging means, said hanging means providing a useful means to hang said packaging blank when constructed into a display carton.

10. A packaging blank according to claim 9, wherein at least one side of said packaging blank is finished and includes printed media.

11. A packaging blank according to claim 9, wherein said packaging blank consists essentially of a one-piece flexible blank and said pliable reinforcing sheet.

12. A packaging blank according to claim 9, wherein said hanger panel is substantially rectangular.

13. A packaging blank according to claim 9, wherein said front hangar tab panel has a depth greater than said rear hanger tab panel such that said front hanger tab panel overlaps at least a portion of said back panel when said front hanger tab panel is folded over and against said rear hanger tab panel during construction of said packaging blank into a display carton.

14. A packaging blank according to claim 9, wherein said hanging means comprises:

a C-shaped cut-out defined by said hanger panel; and a hook-shaped cut-out defined by said reinforcing sheet;

wherein said hanger panel cut-out and said reinforcing sheet cut-out are aligned to correspondingly form a substantially hook-shaped cut-out in said hanger panel when said front hanger tab panel is folded over and against said rear hanger tab panel along said hanger panel fold line during construction of a display carton.

15. A packaging blank according to claim 9, wherein said hanging means comprises:

a substantially rectangular shaped cut-out in said hanger panel; and a hook-shaped cut-out defined by said pliable reinforcing sheet;

wherein at least a portion of said reinforcing sheet is exposed when said front hanger tab panel is folded over and against said rear hanger tab panel along said hanger panel fold line during construction of a display carton to thereby facilitate the ease with which the display carton is secured to and removed from a merchandise display rack.

16. A packaging blank according to claim 9, wherein said front hanger tab panel includes a pair of flanges disposed on opposite sides of said front hanger tab panel, said flanges having a depth substantially equal to said rear hanger tab panel, such that when said front hanger tab panel is folded over and against said rear hanger tab panel during construction of a display carton, said flanges conceal said rear hanger tab panel and said reinforcing sheet from view to thereby provide an aesthetically appealing display carton.

17. A packaging blank according to claim 9, further comprising:

a pair of closure panels attached to said top and bottom boundary of said front panel; and a pair of dust flaps formed at opposing ends of said left side panel and said right side panel;

wherein said closure panels further comprise a tuck flap formed at one end of each pair of said closure panels.

18. A packaging blank according to claim 9, wherein said front panel, said left side panel, or said right side panel define at least one opening such that at least a portion of said back panel, said left side panel, or said right side panel is viewable through said opening when said packaging blank is constructed into a carton.

19. A packaging blank according to claim 18, further comprising a sheet of transparent film secured to at least one side of said packaging blank adjacent said opening such that said transparent film covers said opening.

20. A display carton comprising:

a substantially rectangular front panel having a top and bottom boundary;

a substantially rectangular back panel having a top and bottom boundary; and a hanger panel joined to and extending beyond said top boundary of said back panel, said hanger panel having a front hanger tab panel, a rear hanger tab panel, and a pliable reinforcing sheet that is secured between said front hanger tab panel and said rear hanger tab panel;

wherein said hanger panel defines a hanging means, said hanging means providing a useful means to hang said display carton.

21. A display carton according to claim 20, wherein said hanging means comprises hook-shaped cut-outs defined by said pliable reinforcing sheet and either said front hanger tab panel or said rear hanger tab panel, said cut-outs being aligned to correspondingly form a hook-shaped cut-out in said hanger panel.

22. A display carton according to claim 20, wherein said hanging means comprises hook-shaped cut-outs defined by said pliable reinforcing sheet, said front hanger tab panel, and said rear hanger tab panel, said cut-outs being aligned to correspondingly form a hook-shaped cut-out in said hanger panel.

23. A display carton according to claim 20, wherein said hanging means comprises:

a substantially rectangular cut-out defined by said front hanger tab panel and said rear hanger tab panel; and a hook-shaped cut-out defined by said pliable reinforcing sheet, such that at least a portion of said reinforcing sheet is exposed to thereby facilitate the ease with which the display carton is secured to and removed from a merchandise display rack.

24. A display carton having an internally reinforced hanger panel, said carton comprising:

a substantially rectangular front panel having a top and bottom boundary;

a substantially rectangular back panel having a top boundary and a bottom boundary;

a first side panel and a second side panel connecting said front panel to said back panel;

a glue flap that is facially adhered to said first side panel to thereby join at least a portion of said back panel to said first side panel;

a hanger panel joined to and extending beyond said top boundary of said back panel, said hanger panel having a front hanger tab panel and a rear hanger tab panel that are folded over and against each other;

a pliable reinforcing sheet for internally reinforcing said hanger panel, said reinforcing sheet secured between said front hanger tab panel and said rear hanger tab panel; and a pair of closure panels connected to said top and bottom boundary of said front panel;

wherein either said hanger panel, said reinforcing sheet, or both said hanger panel and said reinforcing sheet define a hanging means, said hanging means providing a useful means to hang said display carton.

25. A display carton according to claim 24, wherein said display carton consists essentially of a one-piece flexible blank and said pliable reinforcing sheet.

26. A display carton according to claim 24, wherein said hanger panel is substantially rectangular.

27. A display carton according to claim 24 wherein:

said front panel and said back panel form substantially parallel planes; and said first side panel and said second side panel form substantially parallel planes that are perpendicular to the parallel planes of said front panel and said back panel.

28. A display carton according to claim 24, wherein said front hangar tab panel overlaps at least a portion of said back panel.

29. A display carton according to claim 24, wherein said hanging means comprises:

a hook-shaped cut-out defined by said hanger panel; and a hook-shaped cut-out defined by said pliable reinforcing sheet;

wherein said hanger panel cut-out and said reinforcing sheet cut-out are aligned to correspondingly form a substantially hook-shaped cut-out in said hanger panel.

30. A display carton according to claim 24, wherein said hanging means comprises:

a substantially rectangular shaped cut-out in said hanger panel; and a hook-shaped cut-out defined by said pliable reinforcing sheet;

wherein at least a portion of said reinforcing sheet is exposed to thereby facilitate the ease with which the display carton is secured to and removed from a merchandise display rack.

31. A display carton according to claim 24, wherein said front hanger tab panel includes a pair of flanges disposed on opposite sides of said front hanger tab panel, said flanges having a depth substantially equal to said rear hanger tab panel, such that said flanges conceal said rear hanger tab panel and said pliable reinforcing sheet from view to thereby provide an aesthetically appealing display carton.

32. A display carton according to claim 24, further comprising:

a pair of dust flaps formed at opposing ends of said first side panel and said second side panel;

wherein said closure panels further comprise a tuck flap formed at one end of each pair of said closure panels.

33. A display carton according to claim 24, wherein said display carton includes at least one opening in said front panel, said first side panel, or said second side panel such that at least a portion of said interior surface of said display carton is viewable through said opening.

34. A display carton according to claim 33, further comprising a sheet of transparent film secured to said interior surface of said display carton adjacent to said opening such that said transparent film covers said opening.

35. A display carton according to claim 24, wherein said display carton has an interior surface and an exterior surface, said exterior surface being finished and including printed media.

36. A method for reinforcing a hanger panel of a display carton with a reinforcing sheet having a cut-out, said method comprising:

providing a packaging blank on an in-line apparatus, the packaging blank having:

a substantially rectangular product panel having a top boundary, bottom boundary, left boundary, and right boundary;

a hanger panel defining a cut-out and having a front hanger tab panel and a rear hanger tab panel that define a hanger panel fold line, said hanger panel extending beyond said top boundary of said product panel, said rear hanger tab panel joined to said product panel at said top boundary of said product panel, and said front hanger tab panel being foldable over said rear hanger tab panel along said hanger panel fold line; and providing a pliable reinforcing sheet for reinforcing the hanger panel on the in-line apparatus;

aligning the reinforcing sheet and the packaging blank relative to one another such that the cut-outs in the reinforcing sheet and the hanger panel are aligned; and securing the reinforcing sheet to the packaging blank to thereby provide a packaging blank that is capable of being constructed into a display carton having a reinforced hanger panel.

37. The reinforcing method of claim 36, wherein the step of aligning comprises:

die-cutting a hook-shaped cut-out into the pliable reinforcing sheet on the in-line apparatus;

advancing the packaging blank and the reinforcing sheet to positions adjacent one another.

38. The reinforcing method according to claim 36, wherein the step of securing comprises:

applying adhesive to a portion of the hanger panel to which the reinforcing sheet is secured; and positioning the reinforcing sheet on the portion of the hanger panel having adhesive to thereby secure the reinforcing sheet to the hanger panel.

39. The reinforcing method according to claim 36, and further comprising the steps of:

advancing the packaging blank on the in-line apparatus to a windowing station for applying transparent film to a cut-out defined by the packaging blank;

applying adhesive to a portion of the packaging blank to which the transparent film is secured;

securing edges of the transparent film to areas adjacent the cut-out to thereby form a windowed opening and provide an internal view of the display carton upon construction.

40. A method for internally reinforcing a hanger panel of a display carton with a reinforcing sheet having a cut-out, in which the hanger panel to be reinforced is formed from a packaging blank having cut-outs and fold lines, said method comprising:

providing a packaging blank on an in-line apparatus, the packaging blank having:

a substantially rectangular front panel having a top boundary, bottom boundary, left boundary, and right boundary;

a substantially rectangular back panel having a top boundary, bottom boundary, left boundary, and right boundary;

a left side panel joined to said front panel at said left boundary of said front panel;

a right side panel joined to said front panel at said right boundary of said front panel, and joined to said back panel at said left boundary of said back panel;

a glue flap joined to said right boundary of said back panel;

a hanger panel defining a cut-out and having a front hanger tab panel and a rear hanger tab panel that define a hanger panel fold line, said hanger panel extending beyond said top boundary of said back panel, said rear hanger tab panel joined to said back panel at said top boundary of said back panel, and said front hanger tab panel being foldable over said rear hanger tab panel along said hanger panel fold line; and providing a pliable reinforcing sheet for reinforcing the hanger panel on the in-line apparatus;

aligning the reinforcing sheet and the packaging blank relative to one another such that the cut-outs in the reinforcing sheet and the hanger panel are aligned; and securing the reinforcing sheet to the packaging blank to thereby provide a packaging blank that is capable of being constructed into a display carton having an internally reinforced hanger panel.

41. The reinforcing method of claim 40, wherein the step of aligning comprises:

die-cutting a hook-shaped cut-out into the pliable reinforcing sheet on the in-line apparatus;

advancing the packaging blank and the reinforcing sheet to positions adjacent one another.

42. The reinforcing method according to claim 40, wherein the step of securing comprises:

applying adhesive to a portion of the hanger panel to which the reinforcing sheet is secured; and positioning the reinforcing sheet on the portion of the hanger panel having adhesive to thereby secure the reinforcing sheet to the hanger panel.

43. The reinforcing method according to claim 40, and further comprising the steps of:

advancing the packaging blank on the in-line apparatus to a windowing station for applying transparent film to a cut-out in the packaging blank;

applying adhesive to a portion of the packaging blank to which the transparent film is secured;

securing edges of the transparent film to areas adjacent the cut-out to thereby form a windowed opening and provide an internal view of the display carton upon construction.

* * * * *

UNITED STATES PATENT AND TRADEMARK OFFICE

CERTIFICATE OF CORRECTION

PATENT NO. : 6,598,746 B2
DATED : July 29, 2003
INVENTOR(S) : Lux, Jr. et al.

It is certified that error appears in the above-identified patent and that said Letters Patent is hereby corrected as shown below:

Column 5,
Line 47, "20" should read -- 24 --.
Line 54, "17" should read -- 33 --.

Column 6,
Line 48, "17" should read -- 33 --.

Signed and Sealed this

Twenty-fifth Day of November, 2003

JAMES E. ROGAN
*Director of the United States Patent and Trademark Office*